US012638172B2

(12) United States Patent
Zhu et al.

(10) Patent No.: US 12,638,172 B2
(45) Date of Patent: May 26, 2026

(54) PULVERIZED COAL BOILER WITH BOTTOM COMBUSTOR, AND CONTROL METHOD THEREFOR

(71) Applicant: INSTITUTE OF ENGINEERING THERMOPHYSICS, CHINESE ACADAMY OF SCIENCES, Beijing (CN)

(72) Inventors: Jianguo Zhu, Beijing (CN); Baihang Li, Beijing (CN); Shiyuan Li, Beijing (CN); Ming Gao, Beijing (CN); Chengbo Man, Beijing (CN); Qinggang Lv, Beijing (CN)

(73) Assignee: INSTITUTE OF ENGINEERING THERMOPHYSICS, CHINESE ACADAMY OF SCIENCES, Beijing (CN)

( * ) Notice: Subject to any disclaimer, the term of this patent is extended or adjusted under 35 U.S.C. 154(b) by 1116 days.

(21) Appl. No.: 17/640,636

(22) PCT Filed: Sep. 4, 2020

(86) PCT No.: PCT/CN2020/113400
§ 371 (c)(1),
(2) Date: Oct. 3, 2022

(87) PCT Pub. No.: WO2021/043241
PCT Pub. Date: Mar. 11, 2021

(65) Prior Publication Data

US 2023/0022074 A1 Jan. 26, 2023

(30) Foreign Application Priority Data

Sep. 5, 2019 (CN) ..... 201910835341.3

(51) Int. Cl.
*F23C 5/08* (2006.01)
*F23C 1/12* (2006.01)

(52) U.S. Cl.
CPC . *F23C 5/12* (2013.01); *F23C 1/12* (2013.01)

(58) Field of Classification Search
CPC ..... F23C 7/00; F23C 7/02; F23L 9/00; F23L 9/06
See application file for complete search history.

(56) References Cited

U.S. PATENT DOCUMENTS 3,980,486 A * 9/1976 Touborg ..... F27B 7/2033 106/761
4,475,472 A * 10/1984 Adrian ..... F23K 1/00 110/211

(Continued)

FOREIGN PATENT DOCUMENTS

CN 1598403 A 3/2005
CN 101363625 A 2/2009

(Continued)

OTHER PUBLICATIONS

International Search Report and Written Opinion dated Dec. 3, 2020 received in International Application No. PCT/CN2020/113400 together with an English language translation.

(Continued)

*Primary Examiner* — David J Laux
(74) *Attorney, Agent, or Firm* — Scully, Scott, Murphy & Presser, P.C.

(57) ABSTRACT

Provided are a pulverized coal boiler with a bottom combustor, and a control method for the pulverized coal boiler, wherein the pulverized coal boiler includes a furnace, at least one bottom combustor and a secondary air distributing device. Each combustor is provided with a combustor spout, and the secondary air distributing device surrounds the combustor and is arranged at the bottom of the furnace. The (Continued)

secondary air distributing device includes an internal secondary air distributing device and an external secondary air distributing device, wherein the internal secondary air distributing device includes an internal secondary air gathering box and an internal secondary air pipe, and the external secondary air distributing device includes an external secondary air gathering box and an external secondary air pipe.

16 Claims, 3 Drawing Sheets

(56) References Cited

U.S. PATENT DOCUMENTS

| | | | | |
|---|---|---|---|---|
| RE33,230 E | * | 6/1990 | Engstrom | F23C 10/20 34/582 |
| 5,007,354 A | * | 4/1991 | Uppstu | F23M 9/02 110/297 |

FOREIGN PATENT DOCUMENTS

| | | | |
|---|---|---|---|
| CN | 102434878 | A | 5/2012 |
| CN | 104728856 | A | 6/2015 |
| CN | 205119048 | U | 3/2016 |
| CN | 107044632 | A | 8/2017 |
| CN | 107559818 | A | 1/2018 |
| CN | 208871609 | U | 5/2019 |

OTHER PUBLICATIONS

First Office Action dated Jun. 25, 2021 received in Chinese Patent Application No. CN 201910835341.3 together with an English language translation.

Second Office Action dated Mar. 7, 2022 received in Chinese Patent Application No. CN 201910835341.3.

* cited by examiner

PULVERIZED COAL BOILER WITH BOTTOM COMBUSTOR, AND CONTROL METHOD THEREFOR

TECHNICAL FIELD

Embodiments of the present disclosure relate to the field of boilers, and in particular, to a pulverized-coal boiler and a method for controlling the same.

BACKGROUND

The coal-fired industrial boilers are important thermal power equipment and are widely used in factory power, building heating, people's lives and other aspects.

However, the existing coal-fired industrial boilers have the following technical defects.

Deflagration tends to be generated at an ignition time of pulverized coal, which is mainly caused by a cold pulverized coal fed into a furnace. The cold pulverized coal needs to be preheated, volatilized and precipitated, and ignited in the furnace, and a temperature in the furnace is relatively low at the ignition time. Hence, the ignition time is increased, thereby increasing the tendency of deflagration.

There is a risk of vibration generated in the boiler, which is mainly caused by poor combustion stability of the pulverized coal and continuous pressure fluctuation in the furnace. In particular, during a low-load operation, the temperature in the furnace is relatively low, and a combustion flame of the pulverized coal cannot continue to be spread, thereby increasing the risk of boiler vibration.

An original NOx emission level of the pulverized coal combustion is high. The original NOx emission level is mostly above 200 $mg/m^3$, a tail denitrification cost is high, and there is a risk of secondary pollution.

The mainstream industrial pulverized-coal boilers mainly include horizontal pulverized-coal boilers and vertical pulverized-coal boilers. Compared with the horizontal pulverized-coal boilers, a flow field in a furnace of the vertical pulverized-coal boiler is easier to be controlled and the boiler thermal efficiency is higher.

In addition, Chinese patent No. ZL201710425369.0 discloses a vertical pulverized-coal boiler with a bottom burner. The vertical pulverized-coal boiler includes a secondary air distribution duct arranged on the entire cross section of the bottom portion of the furnace to supply a secondary air. Therefore, the air supply is uniform, such that there is almost no entrainment and backflow and a velocity difference across the cross section of the furnace is small. Thus, a dispersed air-pulverized coal mixture flows upwardly as a whole, thereby changing the conventional air surrounding pulverized-coal combustion. The disclosure realizes an upward flow of the air-pulverized coal mixture throughout a furnace space, and there is no backflow zone in the furnace, which avoids an accumulation and agglomeration of pulverized-coal particles in the furnace and improves the operation stability of the system.

However, in the above document, it is difficult to achieve partition control of the secondary air, and the temperature in the furnace and pollution cannot be controlled.

SUMMARY

The present disclosure is made in order to alleviate or solve at least one aspect of the above problems of the pulverized-coal boiler.

According to a first aspect according to embodiments of the present disclosure, there is provided a pulverized-coal boiler with a bottom combustor. The pulverized-coal boiler includes a furnace; at least one burner provided at a bottom portion of the furnace, each of the at least one burner having a burner spout, and primary air carrying pulverized coal to flow through the burner spout upwards into the furnace; and a secondary air distribution device provided around the at least one burner and arranged at the bottom portion of the furnace, the secondary air distribution device being configured to inject secondary air upwards. The secondary air distribution device includes an internal secondary air distribution device and an external secondary air distribution device. The internal secondary air distribution device includes an internal secondary-air manifold and an internal secondary air duct, the internal secondary air duct is connected to the internal secondary-air manifold and has a plurality of internal secondary air outlets located within the furnace, and at least part of the plurality of internal secondary air outlets are arranged adjacent to the burner spout. The external secondary air distribution device includes an external secondary-air manifold and external secondary air ducts, and the external secondary air ducts are connected to the external secondary-air manifold and each has a plurality of external secondary air outlets located within the furnace. The internal secondary-air manifold is independent of the external secondary-air manifold.

According to a second aspect according to embodiments of the present disclosure, there is provided a method for controlling a pulverized-coal boiler. The method includes: injecting, through at least one burner provided at a bottom portion of a furnace, pulverized coal fuel upwards into the furnace; and injecting, through a secondary air distribution device arranged around the at least one burner at the bottom portion of the furnace, secondary air upwards into the furnace. The secondary air distribution device includes an internal secondary air distribution device and an external secondary air distribution device. The internal secondary air distribution device includes an internal secondary-air manifold and an internal secondary air duct provided adjacent to a burner spout of the at least one burner, the external secondary air distribution device includes an external secondary-air manifold and external secondary air ducts, and the internal secondary-air manifold is independent of the external secondary-air manifold. The method further includes individually controlling an air volume entering each of the internal secondary-air manifold and the external secondary-air manifold.

BRIEF DESCRIPTION OF DRAWINGS

The following description and drawings can facilitate to understand these and other features and advantages in various embodiments disclosed in the present disclosure. The same reference signs in the drawings always indicate the same components, wherein.

DESCRIPTION OF EMBODIMENTS

Figure 1:
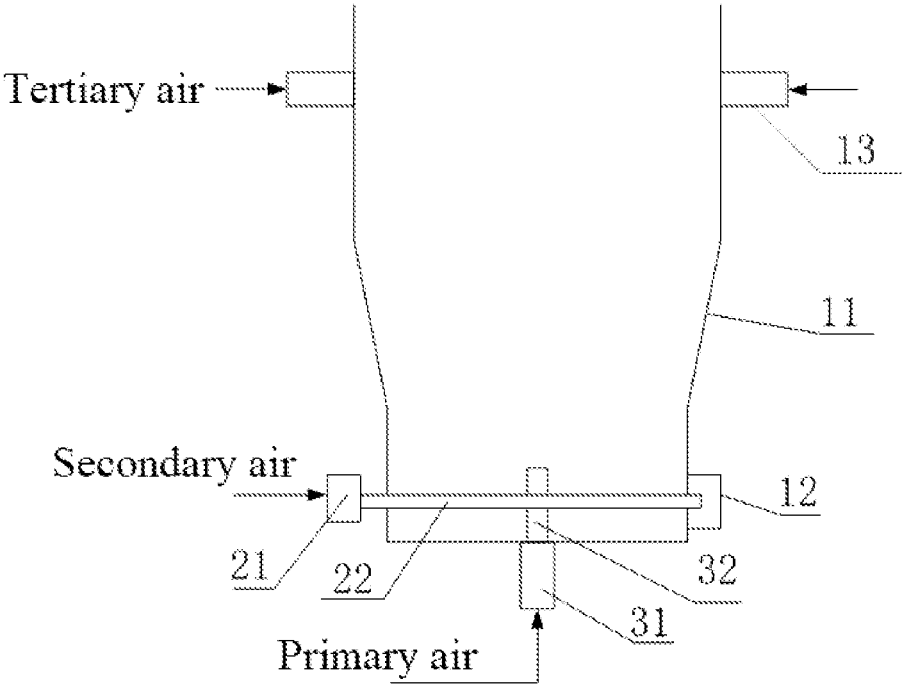
FIG. 1 is a schematic front view of a pulverized-coal boiler according to an exemplary embodiment of the present disclosure.

The technical solutions of the present disclosure will be further described below in detail through embodiments and in conjunction with the drawings. The same or similar reference signs indicate the same or similar components throughout the description. The following description of embodiments of the present disclosure with reference to the drawings is intended to explain the general inventive concept of the present disclosure, and should not be construed as a limitation to the present disclosure.

FIGS. 1 to 5 show schematic views of a pulverized-coal boiler according to exemplary embodiments of the present disclosure.

As shown in FIGS. 1 to 5, a vertical pulverized-coal boiler with a bottom burner includes a furnace 11, a burner 31 arranged at a bottom portion of the furnace 11, a burner spout 32 arranged in communication with the burner 31, a secondary-air manifold 21 arranged at the bottom portion or a side surface near the bottom portion of the furnace 11, and secondary air ducts 22 arranged in communication with the secondary-air manifold and extending from the manifold to an inside of the furnace. The burner spout 32 extends upwardly from outside of the bottom portion of the furnace into an inner cavity of the furnace, and feeds a mixture of primary air and pulverized coal into the furnace 11. Each of the secondary art ducts is provided with a plurality of air caps 23.

Further, the secondary air ducts include an internal secondary air duct 22*a* and external secondary air ducts 22*b*. The internal secondary air duct 22*a* is a secondary air duct proximate to the burner spout 32, and the remaining secondary air ducts are the external secondary air ducts 22*b*. The internal and external secondary air ducts are in communication with different secondary-air manifolds, respectively. In other words, in an embodiment of the present disclosure, the secondary-air manifold includes an internal secondary-air manifold and an external secondary-air manifold, which are arranged independent of each other to individually control an air volume in the air manifolds.

As should be understood by those skilled in the art, the burner spout 32 does not overlap the secondary air ducts 22 in a top view of a middle section of the furnace 11.

As should be understood by those skilled in the art, air outlets on the secondary air ducts may be direct air outlets, or may be provided with the air caps 23 as described above. As can be understood by those skilled in the art, the secondary air outlets are evenly distributed at the bottom portion of the furnace.

As shown in FIG. 1, the furnace is further provided with a tertiary air inlet 13 arranged on a side wall in the middle of the furnace 11, and configured to introduce tertiary air into the furnace 11 to burn out fuel. Tertiary air outlets are arranged oppositely on front and rear walls of the furnace or arranged in a tangential circle at four corners.

As shown in FIGS. 2 to 5, the burner spout 32 may include one or more burner spouts.

The furnace 11 may be a square column structure formed by enclosing four membrane sidewalls, and the membrane sidewalls include a front wall, a rear wall, a left sidewall, and a right sidewall. In an embodiment, the furnace may be a cylindrical structure or other column structures.

The present disclosure is illustratively described in detail below with reference to the accompanying drawings.

Figure 2:
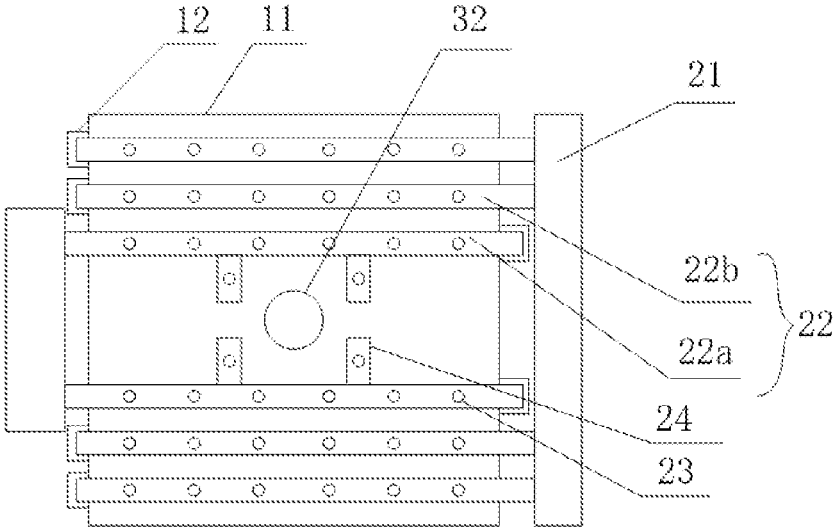
FIG. 2 is a schematic structural view of a pulverized-coal boiler with a secondary air distribution device according to an exemplary embodiment of the present disclosure.

As shown in FIG. 2, a vertical pulverized-coal boiler includes a furnace 11 configured to define a space for fuel combustion, a burner 31 arranged at a bottom portion of the furnace 11, a burner spout 32 arranged in communication with the burner 31, secondary-air manifolds 21 arranged at an outer side of a lower portion of the furnace 11, secondary air ducts 22 arranged in communication with the secondary-air manifolds and extending from the secondary-air manifolds into the furnace, branch ducts 24, and air caps 23. The burner spout 32 extends upwardly from outside of the bottom portion of the furnace into the inner cavity of the furnace, and is configured to feed a mixture of primary air and pulverized coal into the furnace 11. The secondary air ducts disposed near the burner spout are internal secondary air ducts 22*a*, and the remaining secondary air ducts are external secondary air ducts 22*b*. The branch duct 24 is arranged on a side of a corresponding one of the internal secondary air ducts 22*a* close to the burner spout 32 and in communication with the internal secondary air duct 22*a*. Each of the secondary air ducts 22 and the branch ducts 24 is provided with the air caps 23. Further, one of the secondary-air manifolds is only connected to the internal secondary air ducts 22*a*, and another of the secondary-air manifolds is connected to the external secondary air ducts 22*b*. The air volumes flowing into the two secondary-air manifolds are controlled individually, such that secondary air volumes flowing close to and away from the burner spout 32 are controlled separately to realize an optimization of a flow field in the boiler.

Figure 6:
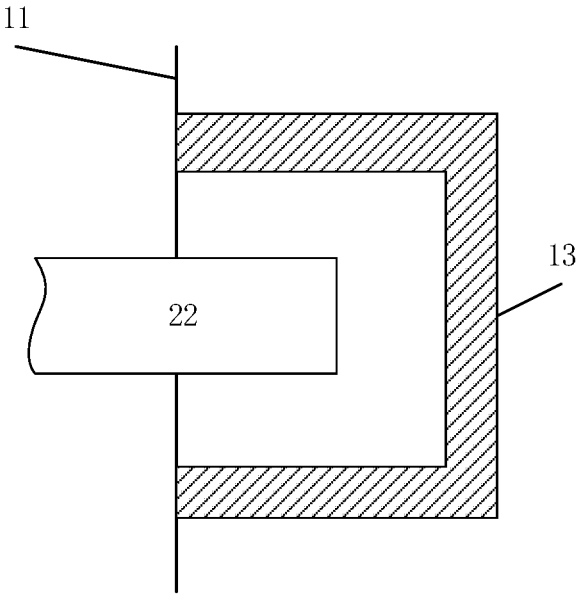
FIG. 6 is a schematic structural view of an expandable protection cover according to an exemplary embodiment of the present disclosure.

The secondary air duct 22 may be in the form of penetrating through the furnace, as shown in FIG. 2. One end of the secondary air duct 22 close to the secondary-air manifold 21 is fixedly connected with and sealed to the sidewall of the boiler 11 through welding or other means. The other end of the secondary air duct 22 is jointed to the boiler 11 or connected to the boiler 11 in other non-fixed manners. An expandable protection cover 12 (as shown in FIG. 6) is disposed outside the furnace, surrounds the secondary air ducts passing through the furnace, and forms a seal against the furnace. The expandable protection cover 12 is configured to provide a sufficient expansion space for the secondary air ducts, and may be sealed through welding or other manners to prevent gas from entering or flowing out of the furnace 11 through the expandable protection cover 12.

The secondary air duct 22 may extend from the bottom portion of the furnace into the furnace and be bent horizontally, and then extend horizontally.

In an embodiment of the present disclosure, a height of an air outlet of each of the air caps 23 arranged on the internal secondary air duct 22*a* and the branch ducts 24 on a horizontal plane is lower than an outlet of the burner spout 32, which is beneficial to reduce the impact of the secondary air on ignition.

The number of the secondary air ducts 22, a diameter/a section width of the secondary air duct 22 and a sectional size of the air outlet of the air cap arranged on the secondary air duct may be determined according to a cross-sectional area of the furnace 11 based on a resistance calculation.

Figure 3:
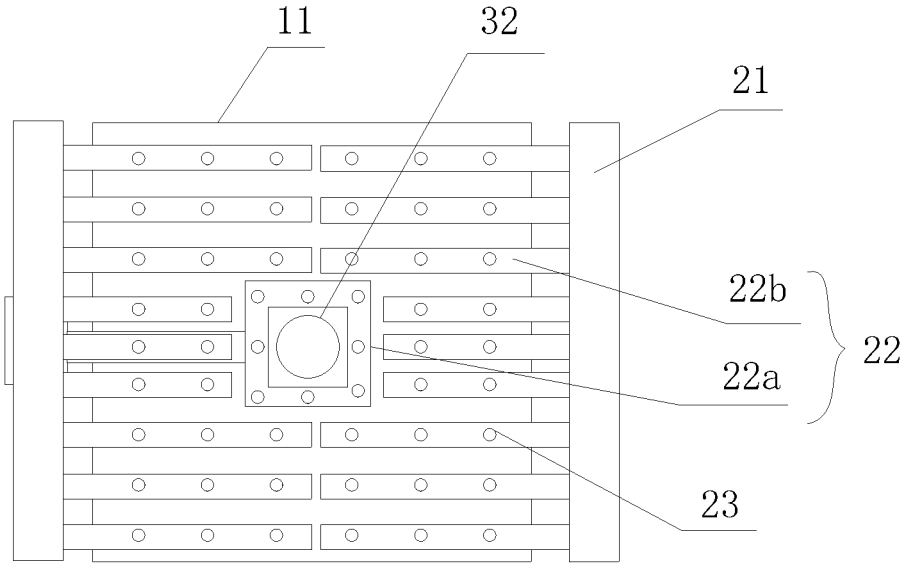
FIG. 3 is a schematic structural view of a pulverized-coal boiler with a secondary air distribution device according to an exemplary embodiment of the present disclosure.
Figure 4:
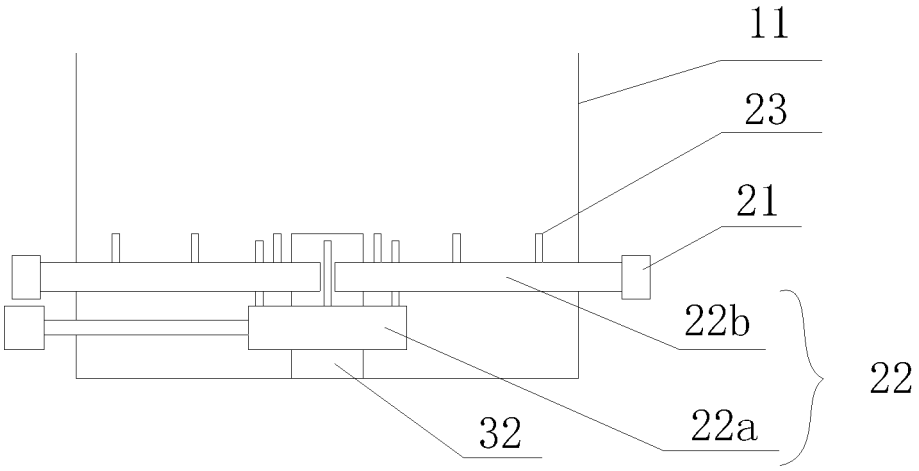
FIG. 4 is a schematic partial front view of the pulverized-coal boiler shown in FIG. 3.

FIGS. 3 and 4 show another exemplary embodiment of the present disclosure. In this embodiment, the boiler includes three secondary-air manifolds 21. One of the three secondary-air manifolds 21 is only connected to the internal secondary air duct 22*a* by a rigid pipe, and the internal secondary air duct 22*a* has a ⊟ -shaped structure to surround the burner spout 32, as shown in FIG. 3. Further, the other two secondary-air manifolds 21 are respectively connected to two sets of external secondary air ducts 22*b*, which extend from an edge towards a center of the furnace and is located close to another set of external secondary air ducts. The external secondary air ducts substantially cover the entire bottom section of the furnace, and an expansion gap is formed between every two adjacent external secondary air ducts. The other two external secondary-air manifolds and the two sets of connected external secondary air ducts are located at the same height. In the top view, the internal secondary air duct does not overlap the external secondary air ducts. In an actual operation, air volumes of the secondary-air manifolds connected to the internal secondary air duct 22*a* and the external secondary air ducts 22*b* are individually controlled to control the secondary air volumes closed to and away from the burner spout 3 individually.

As can be conceivable to those skilled in the art, the internal secondary air duct 22*a* of the ⊟ -shaped structure may be an annular structure.

In an embodiment of the present disclosure, an angle of the air flowing out of the air caps 23 on the internal secondary air duct 22*a* and/or the branch ducts 24 is orientated towards the burner spout, thereby enhancing the mixing of the internal secondary air with the fuel carried by the primary air.

Figure 5:
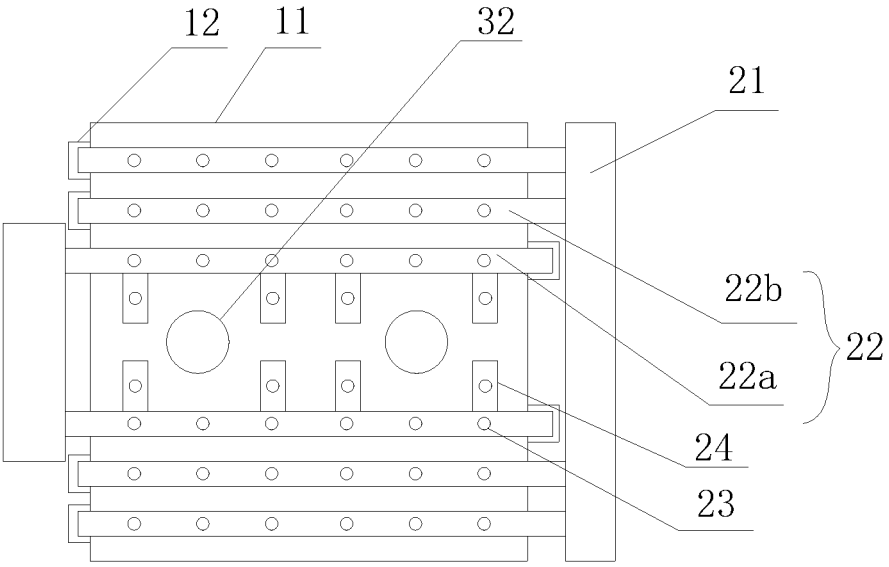
FIG. 5 is a schematic structural view of a pulverized-coal boiler with a secondary air distribution device and two burner spouts according to an exemplary embodiment of the present disclosure.

As can be conceivable to those skilled in the art, in a case where the boiler has a relatively large capacity or under other necessary conditions, a plurality of burner spouts (corresponding to one or more burners) is arranged at the bottom portion of the boiler. As shown in FIG. 5, the furnace is provided with two or more preheating burner spouts. Controllable internal secondary air is supplied at a periphery of each of the preheating burner spouts to increase mixing with preheated fuel, and external secondary air is supplied outside the internal secondary air. Internal secondary air chambers are the same as the spouts of the preheating burner in number, and there is provided with one or more external secondary air chamber, which all fall within the scope of the present disclosure. The secondary air distribution structure may be flexibly adjustable based on the number of burners and the number of burner spouts.

An operation of the pulverized-coal boiler according to exemplary embodiments of the present disclosure will be described below.

The primary air and the preheated fuel are injected from the spout 32 of the preheating burner at an injection velocity of 10 to 30 m/s. The internal secondary air is injected from the internal secondary air distribution device 4 at an injection velocity of 10 to 30 m/s. The internal secondary air closely surrounds the spout of the preheating burner to speed up the mixing with the primary air. The external secondary air may be injected by the distributed air caps 23 and discharged uniformly. In this way, the full-section air supply can delay the rapid mixing and reaction of a large amount of secondary air and the preheated fuel, thereby decreasing the high temperature region where the preheated fuel burns. Meanwhile, the secondary air is supplied from the bottom portion of the furnace, which can prevent deposition of pulverized coal particles on the bottom of the furnace.

An injection velocity of the tertiary air in the furnace is related to the section of the furnace, and is generally between 10 m/s and 20 m/s. The whole region below the tertiary air spout of the furnace is filled with a uniform reducing atmosphere, and a region above the tertiary air spout 13 is a burnout area. The preheated fuel is a mixture of a high temperature coal gas and high temperature coke. The high temperature gas is a gas generated by a reaction of the pulverized coal and the primary air during the preheating of the pulverized coal, and the high temperature coke is a solid substance converted by a reaction of the pulverized coal during the preheating of the pulverized coal. The ratio of the internal secondary air relates to a composition of the preheated fuel, a temperature of the preheated fuel, and a temperature of the furnace. If the preheated fuel gas has a high calorific value, the preheated fuel ignites quickly. The ratio of the internal secondary air can be reduced or the injection speed of the internal secondary air can be increased, in order to control a heat release rate of the preheated fuel combustion. An equivalence ratio of the internal secondary air is generally between 0.1 and 0.3. The external secondary air needs to be combined with the internal secondary air. The internal secondary air mainly ensures rapid ignition and stable combustion of the fuel, and the external secondary air provides combustion-supporting gas for the uniform combustion of the fuel in the whole space of the furnace to ensure the combustion share of the fuel and the heat release. Further, the ratio of external secondary air is higher than that of the internal secondary air. The ratio of the air volumes of the external secondary air to the internal secondary air can be controlled between 5:1 and 2:1, and a total equivalent ratio of the internal secondary air to the external secondary air can be controlled between 0.7 and 0.9. During the combustion process of the preheated fuel, the temperature of the furnace is controlled between 1000° C. and 1200° C. to achieve stable, efficient and low nitrogen combustion of the preheated fuel.

In the above embodiment, the secondary air at the bottom portion of the furnace includes the internal secondary air and the external secondary air surrounding the spout of the preheat burner, and the air volume of the internal secondary air and the air volume of the external secondary air are individually controlled. The internal secondary air is control air and adjustment air for the stable combustion of the fuel, and the external secondary air is the main air for the fuel combustion and has dual functions of adjusting the temperature of the furnace and controlling the atmosphere in the furnace. The whole region below the tertiary air spout of the furnace is filled with the reducing atmosphere, that is, an air equivalence coefficient of the region below the tertiary air spout is less than 1.0.

Through the internal secondary air surrounding the spout of the preheating burner, the rapid mixing and contact of the preheated fuel and the secondary air can be achieved, thereby avoiding the preheated fuel from being extinguished or burning unstably due to the slow mixing with the secondary air or the cooling effect of the water-cooling wall of the furnace. Therefore, the air volume of the internal secondary air relates to the composition of the preheated fuel, the temperature of the preheated fuel, and the temperature of the furnace.

The external secondary air is the main air for the fuel combustion. After a gasification reaction between the preheated fuel and the internal secondary air, the temperature of the furnace rises, and the gasified gas and ungasified gas such as ungasified coke expand outwardly from the center and then are brought into contact with the external secondary air. Since the entire section of the bottom of the furnace is supplied with air by the air caps, the flow field in the furnace is uniform and the substances generated by the reaction of the preheated fuel and the internal secondary air react in the whole furnace space. Further, since the air equivalent ratio of the region below the tertiary air spout of the furnace is less than 1.0 and there is no oxygen-enriched atmosphere in the region below the tertiary air spout of the furnace, a precipitation of nitrogen-containing substances is strengthened during the reaction of the preheated fuel and the internal secondary air. The precipitated nitrogen-containing substances are located in the uniform reducing atmosphere below the tertiary air spout of the furnace. Therefore, a conversion to nitrogen is easy to occur, which can reduce a nitrogen oxide emission level during the preheated fuel combustion.

In the embodiments of the present disclosure, the internal secondary air surrounds a periphery of the preheated fuel, and may be supplied by the air caps. Therefore, it is possible to speed up the mixing of the preheated fuel and the internal secondary air, and ensure the rapid ignition and stable combustion of the preheated fuel. The external secondary air can ensure uniform flow field and composition in the furnace. The main space in the furnace below the tertiary air spout is reducing atmosphere and the local oxygen-enriched atmosphere occupies a small space, which reduces the nitrogen oxide emission level during the preheated fuel combustion.

In general, by increasing the proportion of internal secondary air and enhancing the mixing effect of the secondary air and the pulverized coal carried by the primary air, it is possible for the pulverized coal to ignite rapidly and burn stably. Further, when the central temperature of the furnace is high, such as up to a melting point temperature of the fuel ash, the temperature distribution of the cross section of the furnace can be adjusted by reducing the proportion of the internal secondary air and increasing the proportion of the external secondary air.

It should be noted that in the present disclosure, the "internal" in the term "internal secondary air" is relative to the "external" in the term "external secondary air", and the word "internal" herein refers to one secondary air outlet connected to the individual secondary air manifold that is arranged closer to the burner spout than another secondary air outlet connected to another individual secondary air manifold.

It should also be noted that in the present disclosure, the external secondary air outlets (spouts or air caps) may be arranged in a dispersed arrangement. For example, the external secondary air outlets may be uniformly distributed similar to a lattice as shown. Alternatively, the external secondary air outlets may be an annular arrangement(s) surrounding the internal secondary air distribution device, and these are all within the scope of the present disclosure.

In an alternative embodiment, the secondary air manifolds are arranged at the bottom portion of the furnace, and communicated with the secondary air ducts arranged at the lower part of the furnace through a plurality of pipes extending upwards.

In an alternative embodiment, adjacent secondary air ducts passing through the furnace may share an expandable protection cover.

In an alternative embodiment, the secondary air duct 22 is provided with air distribution holes instead of the air caps, and the air distribution holes may be symmetrically arranged on a side below the secondary air duct along a center line of a vertical direction of the cross section of the secondary air duct. These are all within the scope of the present disclosure.

In view of the above, the present disclosure provides a pulverized-coal boiler with a bottom burner, which includes:

a furnace;

at least one burner provided at a bottom portion of the furnace, each of the at least one burner having a burner spout, through which primary air carries pulverized coal to flow upwards into the furnace; and a secondary air distribution device provided around the burner and arranged at the bottom portion of the furnace, the secondary air distribution device being configured to inject secondary air upwards, wherein the secondary air distribution device includes an internal secondary air distribution device and an external secondary air distribution device;

wherein the internal secondary air distribution device includes an internal secondary-air manifold and an internal secondary air duct, the internal secondary air duct is connected to the internal secondary-air manifold and has a plurality of internal secondary air outlets located within the furnace, at least part of the plurality of internal secondary air outlets are arranged adjacent to the burner spout;

wherein the external secondary air distribution device includes an external secondary-air manifold and an external secondary air duct, the external secondary air duct is connected to the external secondary-air manifold and has a plurality of external secondary air outlets located within the furnace; and wherein the internal secondary-air manifold is independent of the external secondary-air manifold.

Further, the present disclosure also provides a method for controlling a pulverized-coal boiler, which includes: injecting pulverized coal fuel upwards into a furnace through at least one burner disposed at a bottom portion of the furnace; and injecting secondary air upwards into the furnace through a secondary air distribution device arranged around the burner at the bottom of the furnace. The secondary air distribution device includes an internal secondary air distribution device and an external secondary air distribution device. The internal secondary air distribution device includes an internal secondary-air manifold and an internal secondary air duct provided adjacent to the burner spout of the adjacent burner, and the external secondary air distribution device includes an external secondary-air manifold and an external secondary air duct. The internal secondary-air manifold is independent of the external secondary-air manifold. The method further includes individually controlling an air volume flowing into each of the internal secondary-air manifold and the external secondary-air manifold.

In the present disclosure, after injected into the furnace, the fuel such as the preheated fuel is quickly and timely mixed with the secondary air, which shortens the ignition time of the preheated fuel, enhances the combustion stability of the preheated fuel, and avoids or reduces deflagration tendency of the preheated fuel during the ignition and the boiler vibration occurred in the combustion.

In the present disclosure, through the combination and combined control of the internal secondary air and the external secondary air, an advance conversion of nitrogen-containing substances in the mixture of the preheated fuel and the internal secondary air is accelerated, and the main region below the tertiary air spout of the furnace is filled with the uniform reducing atmosphere. Therefore, a local oxygen-enriched region is substantially eliminated, and a reduction degree of nitrogen-containing substances is increased. In addition, a NOx emission level of the preheated fuel combustion is reduced.

In the present disclosure, the internal and external secondary air are controlled separately, that is, partition control of the secondary air is achieved to improve the flexibility of the boiler control, which is beneficial to enhance the mixing of the fuel carried by the primary air and the secondary air, and to ensure the stability of ignition and combustion. Further, it is also beneficial to control the temperature distribution and flow field distribution in the furnace.

Although the embodiments of the present disclosure have been shown and described, it should be understood for those ordinary skilled in the art that modifications and element combination may be made to these embodiments without departing from the principle and spirit of the present disclosure, and the scope thereof is defined by the appended claims and their equivalents.

What is claimed is:

1. A pulverized-coal boiler with a bottom burner, comprising:

a furnace;

at least one burner provided at a bottom portion of the furnace, each of the at least one burner having a burner spout, and primary air carrying pulverized coal to flow through the burner spout upwards into the furnace; and a secondary air distribution device provided around the at least one burner and arranged at the bottom portion of the furnace, the secondary air distribution device being configured to inject secondary air upwards, wherein the secondary air distribution device comprises an internal secondary air distribution device and an external secondary air distribution device;

wherein the internal secondary air distribution device comprises an internal secondary-air manifold and an internal secondary air duct, the internal secondary air duct is connected to the internal secondary-air manifold and has a plurality of internal secondary air outlets located within the furnace, and at least part of the plurality of internal secondary air outlets are arranged adjacent to the burner spout;

wherein the external secondary air distribution device comprises an external secondary-air manifold and external secondary air ducts, and the external secondary air ducts are connected to the external secondary-air manifold and each has a plurality of external secondary air outlets located within the furnace; and wherein the internal secondary-air manifold is independent of the external secondary-air manifold.

2. The pulverized-coal boiler according to claim 1, wherein the internal secondary air duct is an annular duct arranged around the burner spout.

3. The pulverized-coal boiler according to claim 2, wherein the internal secondary-air manifold is disposed adjacent to or around the burner spout below the burner spout.

4. The pulverized-coal boiler according to claim 2, wherein the external secondary air ducts are arranged parallel to each other or extend opposite to each other in an axial direction.

5. The pulverized-coal boiler according to claim 1, wherein the internal secondary air duct is provided with branch ducts extending from the internal secondary air duct, and the at least part of the plurality of internal secondary air outlets are arranged on the branch ducts, respectively.

6. The pulverized-coal boiler according to claim 5, wherein the internal secondary air duct comprises two internal secondary air ducts, and each of the two internal secondary air ducts is arranged on a corresponding side of both sides of the burner spout; and the brunch ducts are arranged between the two internal secondary air ducts and located on both sides of the burner spout in an extending direction of the internal secondary air ducts.

7. The pulverized-coal boiler according to claim 6, wherein each of the two internal secondary air ducts is provided with two branch ducts, and the internal secondary air outlets of the four branch ducts of the two internal secondary air ducts are arranged around the burner spout.

8. The pulverized-coal boiler according to claim 6, wherein the branch ducts comprise two branch ducts connected between the two internal secondary air ducts, the burner spout is located between the two branch ducts, and the internal secondary air outlets of the two branch ducts are arranged around the burner spout.

9. The pulverized-coal boiler according to claim 1, wherein the internal secondary air duct and the external secondary air ducts are arranged parallel to each other.

10. The pulverized-coal boiler according to claim 1, wherein each of the plurality of internal secondary air outlets has a height lower than a height of the burner spout.

11. The pulverized-coal boiler according to claim 1, wherein each of the plurality of internal secondary air outlets has an air outlet angle inclined towards the burner spout.

12. The pulverized-coal boiler according to claim 1, wherein the at least one burner is a preheat burner.

13. A method for controlling a pulverized-coal boiler, comprising:

injecting, through at least one burner provided at a bottom portion of a furnace, pulverized coal fuel upwards into the furnace; and injecting, through a secondary air distribution device arranged around the at least one burner at the bottom portion of the furnace, secondary air upwards into the furnace, wherein the secondary air distribution device comprises an internal secondary air distribution device and an external secondary air distribution device;

wherein the internal secondary air distribution device comprises an internal secondary-air manifold and an internal secondary air duct provided adjacent to a burner spout of the at least one burner, the external secondary air distribution device comprises an external secondary-air manifold and external secondary air ducts, and the internal secondary-air manifold is independent of the external secondary-air manifold; and wherein the method further comprises individually controlling an air volume entering each of the internal secondary-air manifold and the external secondary-air manifold.

14. The method according to claim 13, further comprising:

controlling an equivalence ratio of internal secondary air in a range of 0.1 to 0.3; and controlling an equivalence ratio of external secondary air in a range of 0.3 to 0.6, and controlling a total equivalence ratio of the external secondary air and the internal secondary air in a range of 0.7 to 0.9.

15. The method according to claim 13, further comprising:

increasing the air volume of the internal secondary-air manifold to enhance a mixing of the secondary air with coal powder carried by primary air of the at least one burner.

16. The method according to claim 13, further comprising;

decreasing a proportion of the internal secondary air and increasing a proportion of the external secondary air to lower a temperature at a center of the furnace.

* * * * *